US010787842B2

(12) United States Patent
Savant et al.

(10) Patent No.: US 10,787,842 B2
(45) Date of Patent: Sep. 29, 2020

(54) VEHICLE LATCH ACTIVATION SYSTEM AND MOTOR VEHICLE COMPRISING SUCH VEHICLE LATCH ACTIVATION SYSTEM

(71) Applicant: U-SHIN ITALIA S.P.A, Pianezza (IT)

(72) Inventors: Marco Savant, Pianezza (IT); Anthony Guerin, Pianezza (IT)

(73) Assignee: U-SHIN ITALIA S.P.A., Pianezza (IT)

( * ) Notice: Subject to any disclaimer, the term of this patent is extended or adjusted under 35 U.S.C. 154(b) by 125 days.

(21) Appl. No.: 15/302,523

(22) PCT Filed: May 4, 2015

(86) PCT No.: PCT/EP2015/059712
§ 371 (c)(1),
(2) Date: Oct. 7, 2016

(87) PCT Pub. No.: WO2015/169743
PCT Pub. Date: Nov. 12, 2015

(65) Prior Publication Data

US 2017/0030117 A1 Feb. 2, 2017

(30) Foreign Application Priority Data

May 5, 2014 (EP) ..... 14425052

(51) Int. Cl.
*E05B 77/06* (2014.01)
*E05B 79/20* (2014.01)
*E05B 85/14* (2014.01)

(52) U.S. Cl.
CPC ..... *E05B 77/06* (2013.01); *E05B 79/20* (2013.01); *E05B 85/14* (2013.01)

(58) Field of Classification Search
CPC ..... E05B 77/02; E05B 77/04; E05B 77/06; E05B 79/20; E05B 85/10; E05B 85/14; E05B 85/16; Y10T 292/57; Y10S 292/22
(Continued)

(56) References Cited

U.S. PATENT DOCUMENTS 7,303,217 B2 * 12/2007 Savant ..... E05B 77/06 16/412
8,424,936 B2 * 4/2013 Muller ..... E05B 85/16 292/336.3

(Continued)

FOREIGN PATENT DOCUMENTS

DE 102009044042 A1 3/2011
DE 102012101059 A1 8/2013

(Continued)

OTHER PUBLICATIONS

International Search Report issued in corresponding application No. PCT/EP2015/059712 dated Sep. 4, 2015 (4 pages).

(Continued)

*Primary Examiner* — Christine M Mills
(74) *Attorney, Agent, or Firm* — Burris Law, PLLC

(57) ABSTRACT

The vehicle latch activation system comprises: —a bracket (110), —an activation element (116) intended to activate a latch (102) by rotating with respect to the bracket around an activation axis (118) from an initial position to a final position, wherein a collision on the bracket (110) along a collision direction (L-R) may cause the activation element (116) to rotate from its initial position to its final position, —a blocking element (122) intended, as a result of the collision, to rotate with respect to the bracket (110) around a blocking axis (124), from a disengaged position in which the blocking element (122) allows the activation element (116) to reach its final position, to a blocking position in which the blocking element (122) is intended to block the (Continued)

Figure 1:
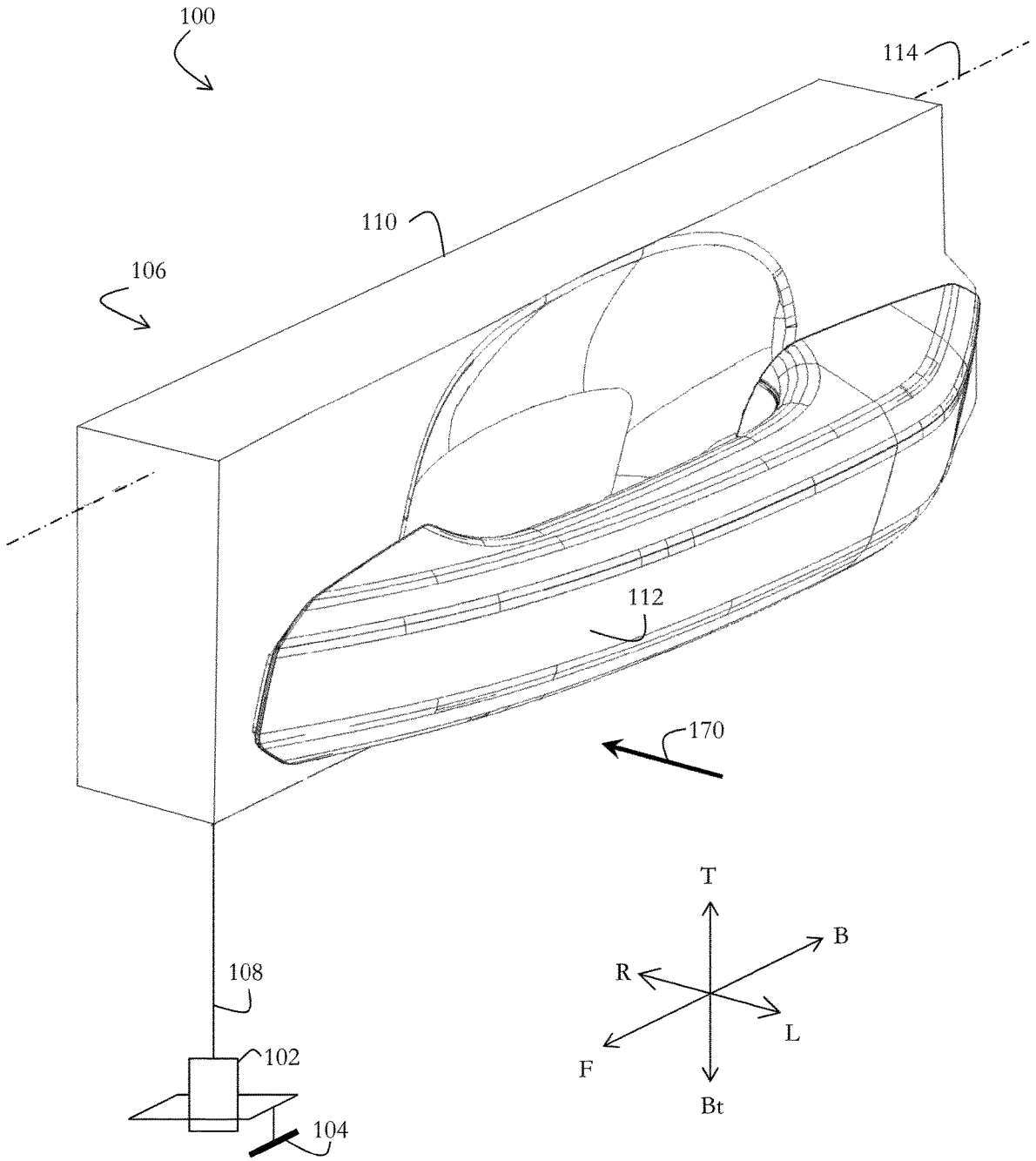

activation element (110) at a blocked position located between the initial position and the final position. The blocking axis (124) is essentially orthogonal to the activation axis (118).

10 Claims, 4 Drawing Sheets

(58) Field of Classification Search
USPC ..... 292/336.3, DIG. 22
See application file for complete search history.

(56) References Cited

U.S. PATENT DOCUMENTS

| | | | | |
|---|---|---|---|---|
| 9,151,320 | B2 * | 10/2015 | Savant | E05B 85/16 |
| 9,435,146 | B2 * | 9/2016 | Muller | E05B 77/06 |
| 9,810,005 | B2 * | 11/2017 | Rocci | E05B 77/06 |
| 9,856,675 | B2 * | 1/2018 | Ilardo | E05L 37/00 |
| 2010/0088855 | A1 | 4/2010 | Ruse et al. | |
| 2012/0061162 | A1 | 3/2012 | Savant et al. | |
| 2012/0074718 | A1 * | 3/2012 | Nagata | E05B 77/06 292/336.3 |
| 2015/0084354 | A1 * | 3/2015 | Lee | E05L 31/003 292/336.3 |
| 2015/0322699 | A1 * | 11/2015 | Ilardo | E05B 77/06 292/336.3 |
| 2017/0030116 | A1 * | 2/2017 | Ilardo | E05B 85/16 |

FOREIGN PATENT DOCUMENTS

| | | | |
|---|---|---|---|
| EP | 2138656 | A2 | 12/2009 |
| EP | 2325419 | A2 | 5/2011 |
| EP | 2434076 | A2 | 3/2012 |
| JP | 2008156935 | A * | 7/2008 |
| WO | 2004/042177 | A1 | 5/2004 |
| WO | 2010/037622 | A1 | 4/2010 |

OTHER PUBLICATIONS

Written Opinion of the International Searching Authority issued in corresponding application No. PCT/EP2015/059712 dated Sep. 4, 2015 (5 pages).

* cited by examiner

VEHICLE LATCH ACTIVATION SYSTEM AND MOTOR VEHICLE COMPRISING SUCH VEHICLE LATCH ACTIVATION SYSTEM

The present invention relates to a vehicle latch activation system and to a motor vehicle comprising such vehicle latch activation system.

Motor vehicle safety standards require that the doors of the vehicle stays closed in case of a collision.

To meet these requirements, the PCT application publication WO 2004/042177 A1 describes a vehicle latch activation system of the type comprising:

a bracket, an activation element intended to activate a latch by rotating with respect to the bracket around an activation axis from an initial position to a final position, wherein a collision on the bracket along a collision direction may cause the activation element to rotate from its initial position to its final position, a blocking element intended, as a result of the collision, to rotate with respect to the bracket around a blocking axis, from a disengaged position in which the blocking element allows the activation element to reach its final position, to a blocking position in which the blocking element is intended to block the activation element at a blocked position located between the initial position and the final position.

In this publication, the blocking element is in the form of a pawl having an end which blocks the activation element when the blocking element is at its blocking position. Thus, the blocking element is placed on the side of the activation axis.

The invention aims at providing an alternative vehicle latch activation system, which allows to free space of the sides of the activation axis.

Accordingly, it is proposed a vehicle latch activation system of the previous type, characterized in that the blocking axis is essentially orthogonal to the activation axis.

Because the blocking axis is not parallel anymore to the activation axis, it is possible to place the blocking element at another location than on the sides of the activation axis, for instance in front of or behind the activation element according to the activation axis.

Optionally, the activation element comprises an activation lever provided with a first stop intended to follow a course when the activation element rotates from its initial position to its final position, and the blocking element comprises a blocking lever having an end portion which is located outside of the course of the first stop of the activation lever when the blocking element is in its disengaged position, and which is located on the course of the first stop of the activation lever when the blocking element is in its blocking position, so as to intercept the first stop of the activation lever.

Also optionally, the end portion of the blocking lever is intended to follow a course when the blocking element rotates from its disengaged position to its blocking position, and the activation lever comprises a second stop located on the course of the end portion of the blocking lever when the activation element is at its initial position, so as to block the end portion of the blocking lever at the blocking position of the blocking element.

Thanks to the second stop of the activation lever, the end portion of the blocking arm is prevented from going beyond the first stop of the activation lever, which helps insuring that the end portion of the blocking element is correctly located to intercept the activation element.

Also optionally, the blocking element comprises a body intended to rotate around the blocking axis, wherein the blocking lever projects from the body of the blocking element and comprises a base portion attached to the body of the blocking element, and the end of the blocking lever is shifted with respect to the base portion of the blocking lever along the blocking axis.

This shifting allows placing the blocking axis at a location shifted with respect to the activation element, i.e. not directly in the continuity of the activation axis. In this manner, a gain of space directly in front of or directly behind the activation element can be obtained.

Also optionally, the blocking element further comprises a mass lever intended to counterbalance the inertia of the blocking lever when the collision occurs.

This option is for example useful when the end of the blocking lever is shifted with respect to the base portion of the blocking lever. In fact, this shifting often implies the use of a bigger blocking element. In that case, the mass lever may help to counterbalance the extra weight.

Also optionally, the activation lever further comprises a guiding wall intended, when the activation element rotates from its initial position to its final position while the blocking element is at its disengaged position, to guide the end of the blocking lever so as to make the blocking element rotate around the blocking axis.

Also optionally, the vehicle latch activation system further comprises:

a handle intended to rotate with respect to the bracket around a handle axis so as to make the activation element rotate from its initial position to its final position, and the handle axis is essentially parallel to the activation axis.

This option allows a better transmission of movement from the handle to the activation element. For instance, it allows the use of a gear mechanism between the handle and the activation element.

Also optionally, the vehicle latch activation system further comprises a gear mechanism between the handle and the activation element.

It is also proposed a motor vehicle comprising:

a door, a latch for the door, a vehicle latch activation system according to the invention for activating the latch.

Optionally, the activation axis is essentially parallel to a front-back direction of the motor vehicle, and the blocking axis is essentially parallel to a top-bottom direction of the motor vehicle.

Figure 2:
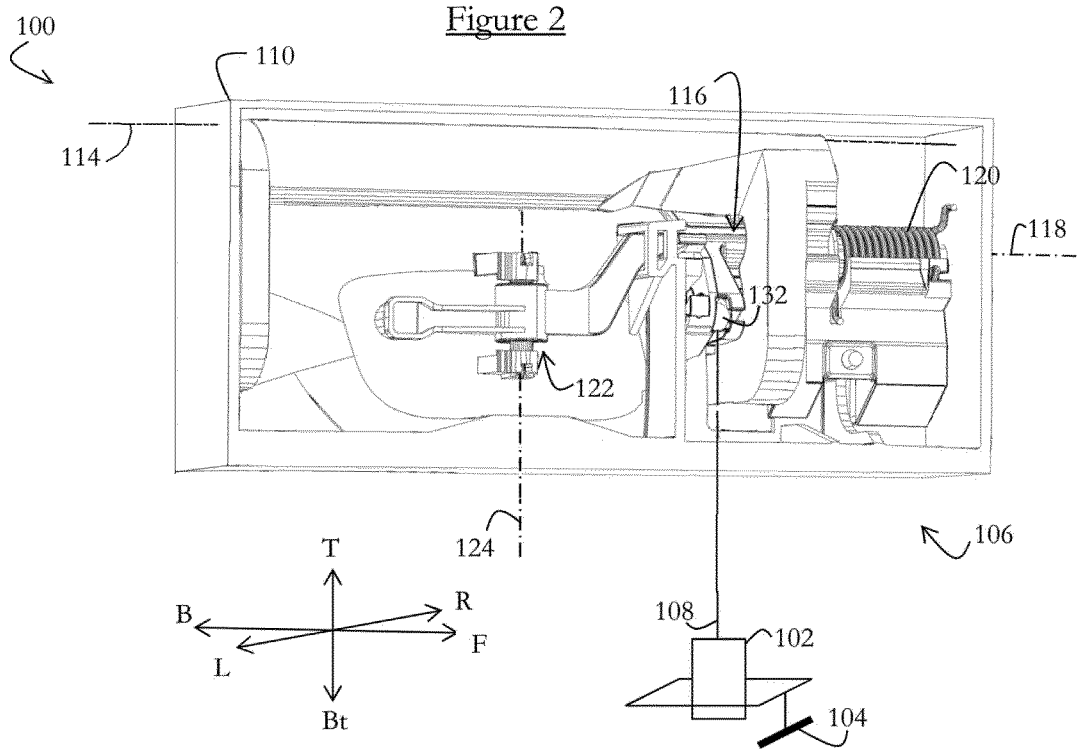
Figure 3:
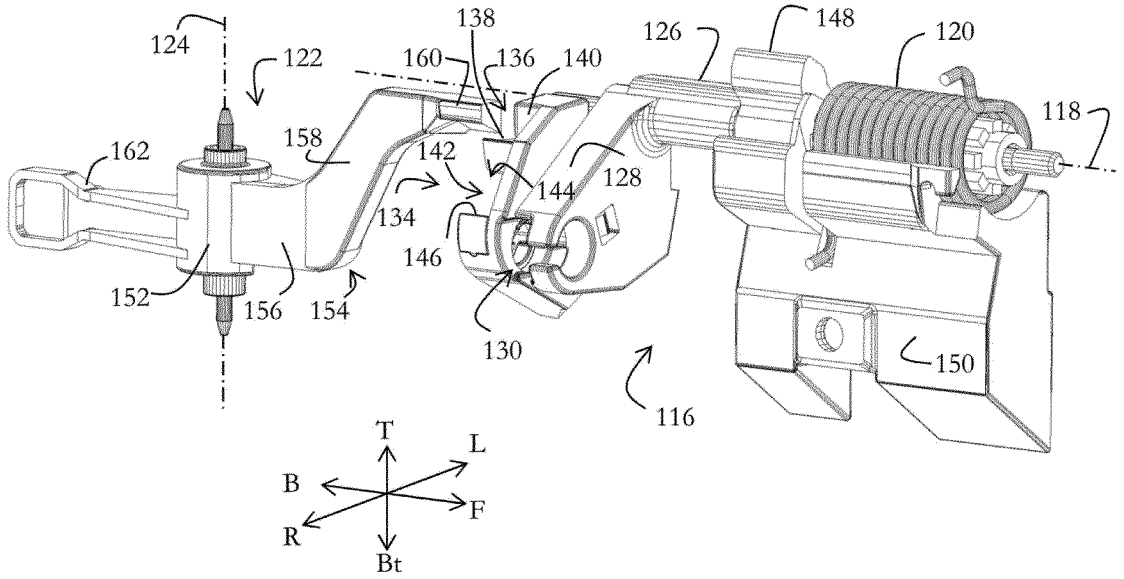
Figure 4:
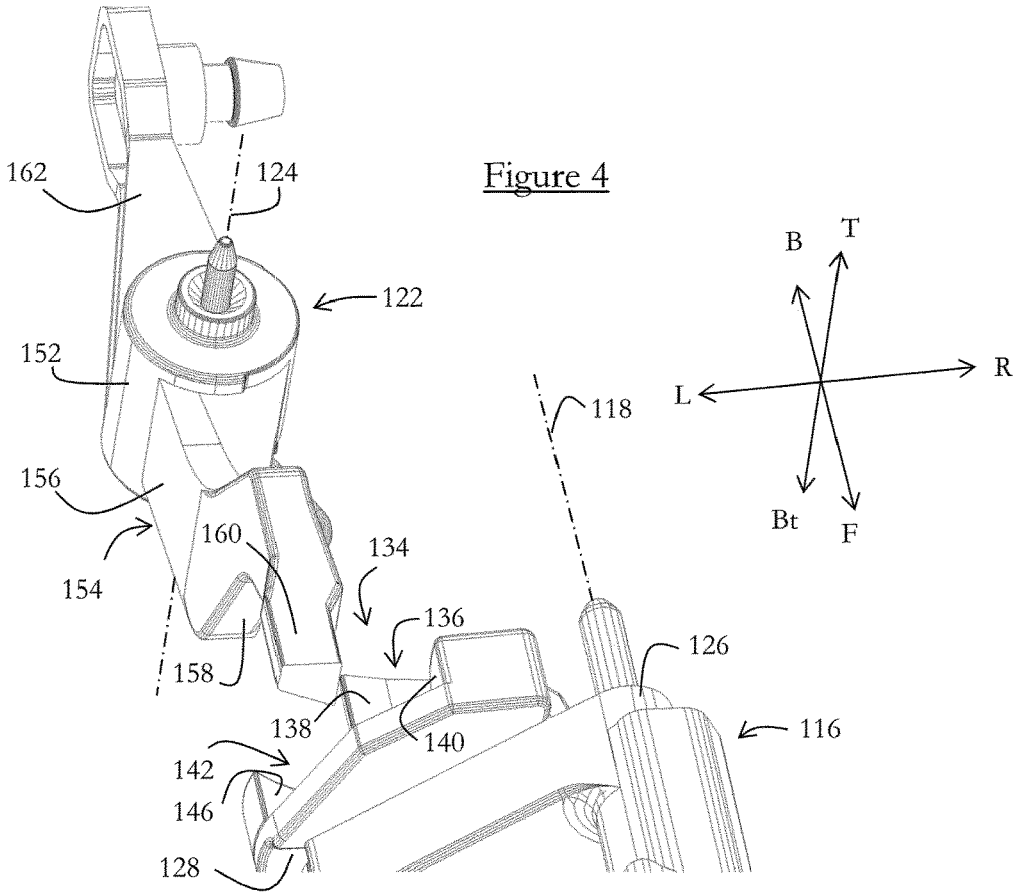
Figure 5:
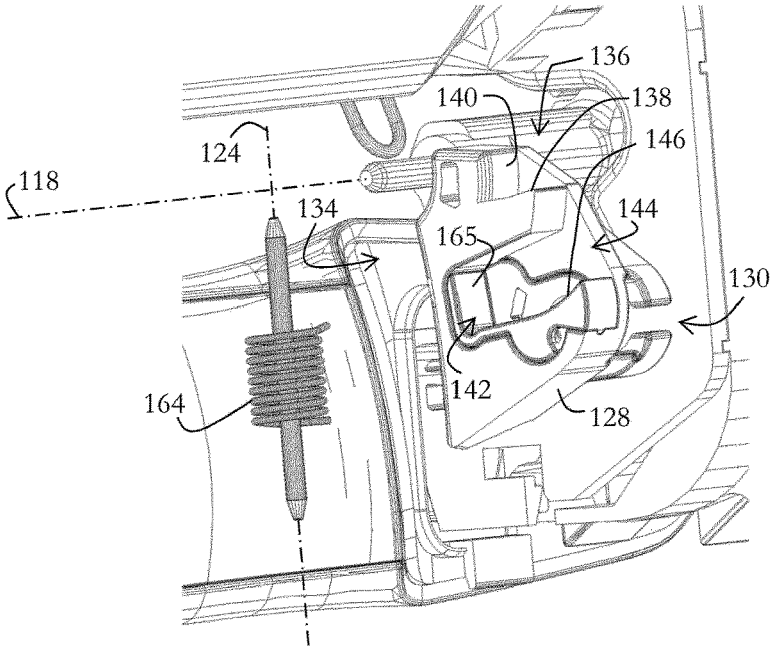
Figure 6:
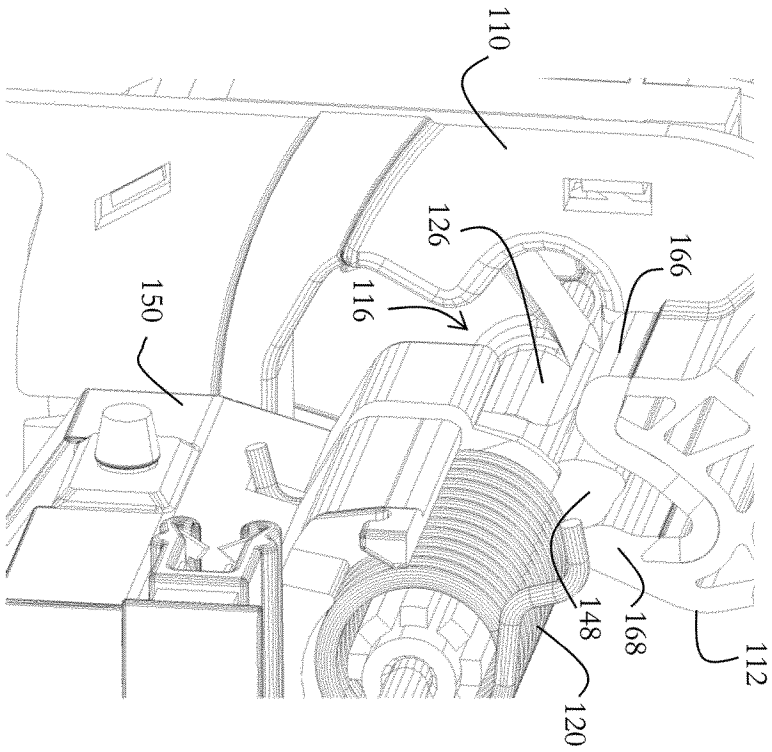

A non-limiting embodiment of the invention will now be described with reference to the accompanying drawings, in which:

FIG. 1 is a three-dimensional view of a vehicle door opening system according to the invention from the exterior of the vehicle, FIG. 2 is a three-dimensional view the vehicle door opening system from the interior of the vehicle, FIGS. 3 and 4 are a three-dimensional view of activation and blocking elements of the vehicle door opening system of the FIGS. 1 and 2, FIG. 5 is a three-dimensional view showing a front part of the activation element, FIG. 6 is a three-dimensional view showing a rear part of the activation element.

In the following description, positioning terms such as front, back, left, right, etc., refer to an orthogonal basis comprising the following three directions: front-back F-B, left-right L-R and top-bottom T-Bt. In the described example, these three directions correspond to the usual directions attached to the motor vehicle. However, in other embodiments of the invention the directions front-back F-B, left-right L-R and top-bottom T-Bt could be any set of arbitrary directions forming an orthogonal basis.

Furthermore, when the term "essentially" is used in a comparison between directions, it means that there is a tolerance of plus or minus 15° in particular for comparing the previous directions attached to the motor vehicle with movement directions of elements of the door opening system that will be described below. Preferably, the tolerance is plus or minus 10°, in particular for the tolerance between two movement directions of the elements of the door opening system that will be described below. For instance, the expression "two essentially parallel directions" means that the angle between the two directions is equal to zero with a tolerance of plus or minus 15°, that is to say that the angle is in the interval from −15° to 15°.

Referring to FIG. 1, a door opening system 100 for a motor vehicle (not depicted) will now be described.

The door opening system 100 first comprises a latch 102 intended, when engaged in a body 104 of the motor vehicle to maintain a door (not depicted) of the motor vehicle closed with respect to the body 104, and, when disengaged from the body 104, to allow opening of the door. In the described example, the door is a left door of the vehicle.

The door opening system 100 further comprises a latch activation system 106 intended to activate the latch 102 via a Bowden cable 108 in order to move the latch 102 from its engaged position to its disengaged position.

The vehicle latch activation system 106 first comprises a bracket 110 attached to the door.

The vehicle latch activation system 106 further comprises a handle 112 intended to be manipulated by a user. The handle 112 is intended to rotate with respect to the bracket 110 around a handle axis 114 extending essentially along the front-back direction F-B, i.e. essentially parallel to the front-back direction F-B. The handle 112 may be a flap handle or a swing handle or any kind of handle rotating around an axis extending essentially along the front-back direction F-B.

Referring to FIG. 2, the vehicle latch activation system 106 further comprises an activation element 116 intended to move with respect to the bracket 110 from an initial position to a final position in order to activate the latch 102. The activation element 116 is intended to rotate around an activation axis 118 extending essentially along the front-back direction F-B, that is to say essentially parallel to the handle axis 114. The activation element 116 is for example made of metallic alloy. Otherwise indicated, the activation element 116 will be described in the following while being at its initial position.

The vehicle latch activation system 106 further comprises an activation element return mechanism 120 intended to push back the activation element 116 towards its initial position. The activation element return mechanism 120 comprises for example a return spring winded around the activation axis 118.

The vehicle latch activation system 106 further comprises a blocking element 122 intended to rotate with respect to the bracket 110 around a blocking axis 124 extending essentially along the top-bottom T-Bt direction.

During its rotation, the blocking element 122 is intended to move with respect to the bracket 110 from a disengaged position (which is the position illustrated on the figures) in which the blocking element 122 allows the activation element 116 to reach its final position, to a blocking position in which the blocking element 122 is intended to block the activation element 116 at a blocked position located between the initial position and the final position. Otherwise indicated, the blocking element 122 will be described in the following while being at its disengaged position.

Referring to FIG. 3, the activation element 116 first comprises a cylindrical body 126 extending around the activation axis 118.

The activation element 116 further comprises an activation lever 128 projecting essentially to the bottom-right from a rear end of the cylindrical body 126.

The latch activation lever 128 comprises a free end provided with a cage 130, in which a ball 132 (illustrated on FIG. 2) is confined. As illustrated on FIG. 2, the Bowden cable 108 connects the ball 132 to the latch 102, so that rotation of the latch activation lever 128 pulls the Bowden cable 108, which in turn disengages the latch 102 from the body 104. In other embodiments, the ball 132 could be replaced by a cylinder. The choice between ball and cylinder depends on the Bowden cable type.

Back to FIG. 3, the latch activation lever 128 further comprises a back face 134 in which a notch 136 is provided. The notch 136 is opened towards the back and towards the right. The notch 136 is delimited below by a stop floor 138 and on the left by a stop wall 140. The stop floor 138 extends essentially horizontally (along the front-back F-B and left-right L-R directions), while the stop wall 140 extends essentially laterally (along the front-back F-B and top-bottom T-Bt directions).

The back face 134 is further provided with a groove 142 located under the notch 136. The groove 142 extends essentially along the right-left R-L direction. The groove 142 has a right open end 144. The groove 142 is delimited below by a guiding wall 146, which extends further to the right than the stop floor 138.

The activation element 116 further comprises a gear tooth 148 projecting from the cylindrical body 126 essentially towards the top.

The latch activation element 116 further comprises a counterweight 150 attached to the cylindrical body 126 and extending essentially under the activation axis 118.

The blocking element 122 first comprises a body having the shape of a sleeve 152 extending around the blocking axis 124.

The blocking element 122 further comprises a blocking arm 154 projecting frontward from the sleeve 152. The blocking arm 154 first comprises a base portion 156 attached to the sleeve 152 and projecting essentially in the frontward direction. The blocking arm 154 further comprises an oblique portion 158 extending from the base portion 156 essentially towards the top and the front. The blocking arm 154 further comprises an end portion 160 projecting from the oblique portion 158 essentially towards the front. Because of the oblique portion 158, the end portion 160 is located higher than the base portion 156 with respect to the top-bottom T-Bt direction. The end portion 160 is located outside the notch 136 and faces the stop wall 140, i.e. the end portion 160 is located on the right of the stop wall 140.

The blocking element 122 further comprises a mass arm 162 projecting from the sleeve 152 at the opposite of the blocking arm 154, that is to say essentially in the backward direction. The mass arm 162 is intended to counterbalance the inertia of the blocking arm 154 in case of a collision on the bracket from the right to the left, in order to set the rotation around the blocking axis 124 to a desired amount.

As it will be appreciated from FIG. 3, the blocking element 122 is located at the rear of the activation element 116, but not directly in the continuity of the activation axis 118. This positioning of the blocking element 122 is possible in particular thanks to the fact that the blocking axis 124 is essentially parallel to the activation axis 118, and thanks to the shifting of the end portion 160 of the blocking lever 154 with respect to the base portion 156 of the blocking lever 154.

Referring to FIG. 4, the end portion 160 of the blocking arm 154 is located on the right of the stop floor 138 of the activation element 116, so that, when the activation element 116 rotates from its initial position to its final position, the end portion 160 of the blocking arm 154 does not intercept the stop floor 138.

However, the end portion 160 of the blocking arm 154 is located above the guiding wall 146, so that, when the activation element 116 rotates from its initial position to its final position, the guiding wall 146 engages the end portion 160 of the blocking arm 154.

Referring to FIG. 5, a better view of the front face 134 of the activation lever 128 is provided.

The vehicle latch activation system 106 further comprises a blocking element return mechanism 164 intended to bring back the blocking element 122 towards its disengaged position. For example, the blocking element return mechanism 164 comprises a return spring winded around the blocking axis 124.

Furthermore, the groove 142 of the activation lever 128 is delimited on the left by a left closed end 165.

Referring to FIG. 6, the handle 112 is intended to be manipulated by a user in order to move the activation element 116 from its initial position to its final position. To this end, the handle 112 comprises two gear teeth 166, 168 between which the gear tooth 148 of the activation element 116 is inserted, so as to form a gear mechanism between the handle 112 and the activation element 116. The gear mechanism 148, 166, 168 is intended to transfer rotation from the handle 112 to the activation element 116 with a relatively constant effort.

Operation of the door opening system 100 will now be described.

When a user manipulates the handle 112 so as to make the handle 112 rotate around the handle axis 114, the gear mechanism 148, 166, 168 transmits the rotation to the activation element 116 so as to make the activation element 116 rotate from its initial position to its final position. By doing so, the activation lever 128 of the activation element 116 pulls the Bowden cable 108, which in turn disengages the latch 102 from the body 104. Concurrently, the stop floor 138 of the activation lever 128 passes next to the end portion 160 of the blocking arm 154 without being intercepted by the end portion 160 of the blocking arm 154. However, the guiding wall 146 engages the end portion 160 of the blocking arm 154 and then guides it so that the end portion 160 of the blocking arm 154 enters the groove 142 through the right open end 144 and slides on the guiding wall 146 so as to move into the groove 142 towards its left closed end 165. This makes the blocking element 122 rotate around the blocking axis 124 away from its disengaged position, towards its blocking position. The guiding wall 146 therefore plays the role of a cam. In this way, the blocking element 122 is moved at each door opening, which prevents the blocking element 122 from being immobilized due to ice, moisture or dust.

In case of a collision 170 on the bracket 110 corning from the left (see FIG. 1), the collision 170 may cause the activation element 116 to rotate from its initial position to its final position. In fact, the collision 170 pushes the bracket 110 towards the right. As a reaction, because of its inertia, the handle 112 tend to move with respect to the bracket 110 towards the left, which makes the activation element 116 rotate around the activation axis 118 towards its final position. Because of that, the latch 102 is at risk of being disengaged and the door opened during the collision 170.

The counterweight 150 provides a first mean to prevent opening of the door during the collision 170. In fact, because of its inertia, the counterweight 150 tends to move towards the left as a result of the collision 170. This tends to make the activation element 116 rotate towards its initial position, which counterbalances the rotation towards the final position resulting from the inertia of the handle 112.

The blocking element 122 provides a second mean to prevent opening of the door during the collision 170, which will now be explained.

The first stop floor 138 is intended to follow a circular course around the activation axis 118 when the activation element 116 rotates from its initial position to its final position. As explained previously, the end portion 160 of the blocking arm 154 is located outside of the course of the stop floor 138 of the activation lever 128 when the blocking element 122 is in its disengaged position.

As a result of the collision 170, because of the combined inertia of the blocking arm 154 and mass arm 162, the blocking element 122 rotates around the blocking axis 124 from its disengaged position towards its blocking position. The end portion 160 of the blocking arm 154 enters the notch 136 from the right and is stopped by the stop wall 140 at its blocking position. In this manner, in case of a strong collision, there is no risk that the end portion 160 of the blocking arm 154 goes too far away to the left and beyond the stop floor 138. In this blocking position, the end portion 160 of the blocking arm 154 is located on the course of the floor stop 138, so that, if the collision 170 makes the activation element 116 rotate towards its final position, the end portion 160 of the blocking arm 154 will intercept the stop floor 138 at the blocked position of the activation element 116.

After the collision 170, the blocking element 122 comes back to its disengaged position thanks to the blocking element return mechanism 164. This kind of blocking element is called reversible.

In the claims below, the terms used should not be interpreted as limiting the claims to the embodiment described in this description, but should be interpreted so as to include all of the equivalents that the claims are intended to cover in their wording and that can be envisaged by a person skilled in the art applying his or her general knowledge to the implementation of the teaching disclosed above.

In particular, it should be noted that the term "latch" should include any means intended to maintain the vehicle door closed.

Furthermore, the counterweight could be freewheeling around the activation axis. In this manner, in case of a collision on the bracket in the right to left direction, that is to say opposite of the collision 170, the counterweight would be uncoupled from the activation element, so that the counterweight would not drag along the activation element towards its final position.

Furthermore, the vehicle latch activation system could also comprise a damper mechanism intended to slow down the return of the blocking element from its blocking position to its disengaged position. For instance, one of the damper mechanisms described in WO 2012/1755599 A1 could be used.

The invention claimed is:

1. A vehicle latch activation system comprising:

a bracket;

an activation element that activates a latch by rotating with respect to the bracket around an activation axis from an initial position to a final position, wherein a collision on the bracket along a collision direction causes the activation element to rotate from the initial position to the final position; and a blocking element that rotates, as a result of the collision, with respect to the bracket around a blocking axis, from a disengaged position in which the blocking element allows the activation element to reach its final position, to a blocking position in which the blocking element blocks the activation element at a blocked position located between the initial position and the final position, wherein the blocking axis is orthogonal to the activation axis, wherein the activation element comprises an activation lever having a back face provided with a first stop that follows a course when the activation element rotates from the initial position to the final position, wherein the blocking element comprises a blocking arm having an end portion that is located outside of the course of the first stop when the blocking element is in the disengaged position, and that is located on the course of the first stop when the blocking element is in the blocking position, so as to intercept the first stop, and wherein the back face further comprises a guiding wall that, when the activation element rotates from the initial position to the final position while the blocking element is at the disengaged position, guides the end portion of the blocking arm so as to make the blocking element rotate around the blocking axis, the back face being provided with a groove extending essentially along a right-left (R-L) direction delimited below by the guiding wall, which extends further to the right than the first stop, the groove being opened toward the right direction and the groove being closed toward the left direction.

2. The vehicle latch activation system according to claim 1, wherein the end portion of the blocking arm follows a course when the blocking element rotates from its disengaged position to its blocking position, and wherein the activation lever comprises a second stop located on the course of the end portion of the blocking arm when the activation element is at its initial position, so as to block the end portion of the blocking arm at the blocking position of the blocking element.

3. The vehicle latch activation system according to claim 1, wherein the blocking element comprises a body that rotates around the blocking axis, wherein the blocking arm projects from the body of the blocking element and comprises a base portion attached to the body of the blocking element, and wherein the end portion of the blocking arm is shifted with respect to the base portion of the blocking arm along the blocking axis.

4. The vehicle latch activation system according to claim 1, wherein the blocking element further comprises a mass arm that counterbalances the inertia of the blocking arm when the collision occurs.

5. The vehicle latch activation system according to claim 1, further comprising:

a handle that rotates with respect to the bracket around a handle axis so as to make the activation element rotate from its initial position to its final position, wherein the handle axis is parallel to the activation axis.

6. The vehicle latch activation system according to claim 5, further comprising a gear mechanism between the handle and the activation element.

7. The vehicle latch activation system according to claim 1, wherein the end portion of the blocking arm is disposed outside the groove when the activation element is in the initial position, and wherein the end portion of the blocking arm enters the groove when the activation element rotates from the initial position to the final position while the blocking element is at the disengaged position.

8. A motor vehicle comprising:

a door;

a latch for the door;

a vehicle latch activation system according to claim 1 for activating the latch.

9. The motor vehicle according to claim 8, wherein the activation axis is parallel to a front-back direction of the motor vehicle, and wherein the blocking axis is parallel to a top-bottom direction of the motor vehicle.

10. A vehicle latch activation system comprising:

a bracket, which is attached to a door;

an activation element that activates a latch by rotating with respect to the bracket around an activation axis from an initial position to a final position, wherein a collision on the bracket along a collision direction causes the activation element to rotate from the initial position to the final position; and a blocking element that rotates, as a result of the collision, with respect to the bracket around a blocking axis, from a disengaged position in which the blocking element allows the activation element to reach its final position, to a blocking position in which the blocking element blocks the activation element at a blocked position located between the initial position and the final position, wherein the blocking axis is orthogonal to the activation axis, wherein the activation element comprises an activation lever having a back face provided with a first stop that follows a course when the activation element rotates from the initial position to the final position, wherein the blocking element comprises a blocking arm having an end portion that is located outside of the course of the first stop when the blocking element is in the disengaged position, and that is located on the course of the first stop when the blocking element is in the blocking position, so as to intercept the first stop, and wherein the back face further comprises a guiding wall that, when the activation element rotates from the initial position to the final position while the blocking element is at the disengaged position, guides the end portion of the blocking arm so as to make the blocking element rotate around the blocking axis, the back face being provided with a groove extending essentially along a right-left (R-L) direction delimited below by the guiding wall, which extends further to the right than the first stop, wherein the right-left (R-L) direction correspond to a usual right-left direction of a motor vehicle when the door is attached to the motor vehicle.

* * * * *